US009709962B2

(12) United States Patent
Ogasawara et al.

(10) Patent No.: US 9,709,962 B2
(45) Date of Patent: Jul. 18, 2017

(54) TIME CORRECTION SYSTEM, ELECTRONIC DEVICE, TIMEPIECE, AND PROGRAM

(71) Applicant: SEIKO INSTRUMENTS INC., Chiba-shi, Chiba (JP)

(72) Inventors: Kenji Ogasawara, Chiba (JP); Akira Takakura, Chiba (JP); Kazuhiro Koyama, Chiba (JP); Tamotsu Maesawa, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 15/035,671

(22) PCT Filed: Sep. 26, 2014

(86) PCT No.: PCT/JP2014/075708
§ 371 (c)(1),
(2) Date: May 10, 2016

(87) PCT Pub. No.: WO2015/072234
PCT Pub. Date: May 21, 2015

(65) Prior Publication Data

US 2016/0274550 A1 Sep. 22, 2016

(30) Foreign Application Priority Data

Nov. 12, 2013 (JP) ..... 2013-234256

(51) Int. Cl.
*G04R 20/26* (2013.01)
*G04R 60/14* (2013.01)
(Continued)

(52) U.S. Cl.
CPC ..... *G04R 20/26* (2013.01); *G04C 9/02* (2013.01); *G04C 10/02* (2013.01); *G04G 5/00* (2013.01);
(Continued)

(58) Field of Classification Search
CPC . G04C 9/02; G04C 10/02; G04G 5/00; G04G 5/002; G04G 7/02; G04G 19/00;
(Continued)

(56) References Cited

U.S. PATENT DOCUMENTS 5,898,643 A * 4/1999 Yasuoka ..... G04C 3/14 368/47
6,751,164 B1 * 6/2004 Sekiguchi ..... G04C 3/146 368/21
(Continued)

OTHER PUBLICATIONS

International Search Report mailed Jan. 6, 2015 in International Application No. PCT/JP2014/075708 together with English translation thereof.
(Continued)

*Primary Examiner* — Vit W Miska
(74) *Attorney, Agent, or Firm* — Adams & Wilks

(57) ABSTRACT

A time correction system includes a timepiece, and an electronic device that corrects the time of the timepiece. The electronic device includes a display unit, a time data acquisition unit, a control unit that causes the display unit to display an instruction time of the electronic timepiece, based on the current time, and that calculates a time correction amount from a difference between the current time and the instruction time, and a light source that transmits the time correction amount to the electronic timepiece. The electronic timepiece includes an input unit that receives an operation input for correcting the time displayed by a display unit, a solar cell that receives the time correction amount from the electronic device, and a control circuit that corrects the time displayed by an indicating hand of the display unit, based on the time correction amount.

8 Claims, 5 Drawing Sheets

(51) Int. Cl.

| | |
|---|---|
| ***G04C 9/02*** | (2006.01) |
| ***G04G 5/00*** | (2013.01) |
| ***G04G 7/00*** | (2006.01) |
| ***G04C 9/00*** | (2006.01) |
| ***G04C 10/02*** | (2006.01) |

(52) U.S. Cl.
CPC ..... *G04G 5/002* (2013.01); *G04G 7/00* (2013.01); *G04R 60/14* (2013.01)

(58) Field of Classification Search
CPC ..... G04G 21/04; G04G 7/00; G04R 20/26; G04R 60/14
See application file for complete search history.

(56) References Cited

U.S. PATENT DOCUMENTS

| | | | | |
|---|---|---|---|---|
| 2005/0105401 | A1 | 5/2005 | Akahane et al. | 368/187 |
| 2013/0064045 | A1* | 3/2013 | Essery | H04W 88/02 368/47 |

OTHER PUBLICATIONS

Abstract, Publication No. JP 2010-261905, Publication Date Nov. 18, 2010.

* cited by examiner

20 ELECTRONIC TIMEPIECE
207 STEPPING MOTOR
202 CONTROL CIRCUIT206 REFERENCE SIGNAL GENERATION CIRCUIT
209 STORAGE UNIT
210 INPUT UNIT

10 ELECTRONIC DEVICE
102 CONTROL UNIT
101 TIME DATA ACQUISITION UNIT
105 DISPLAY UNIT
106 INPUT UNIT

S101 IS TIME CORRECTION INSTRUCTION INPUT?
S102 ACQUIRE CURRENT TIME
S103 DETERMINE INSTRUCTION TIME
S104 DISPLAY INSTRUCTION TIME
S105 IS INSTRUCTION TO TRANSMIT TIME CORRECTION AMOUNT INPUT?
S106 ACQUIRE CURRENT TIME
S107 CALCULATE TIME CORRECTION AMOUNT
S108 TRANSMIT SYNCHRONIZING SIGNAL
S109 TRANSMIT START SIGNAL
S110 TRANSMIT TIME CORRECTION AMOUNT DATA

S201 IS TIME CORRECTED?
S202 STOP CLOCKING
S203 CHANGE MODE TO COMMUNICATION PERIOD
S204 IS SYNCHRONIZING SIGNAL RECEIVED?
S205 RECEIVE TIME CORRECTION AMOUNT DATA
S206 CHANGE MODE TO CHARGING PERIOD
S207 SET TIME CORRECTION AMOUNT
S208 DRIVE MOTOR ONE STEP
S209 DEDUCT 1 FROM TIME CORRECTION AMOUNT
S210 TIME CORRECTION AMOUNT=0?
S211 RESTART CLOCKING

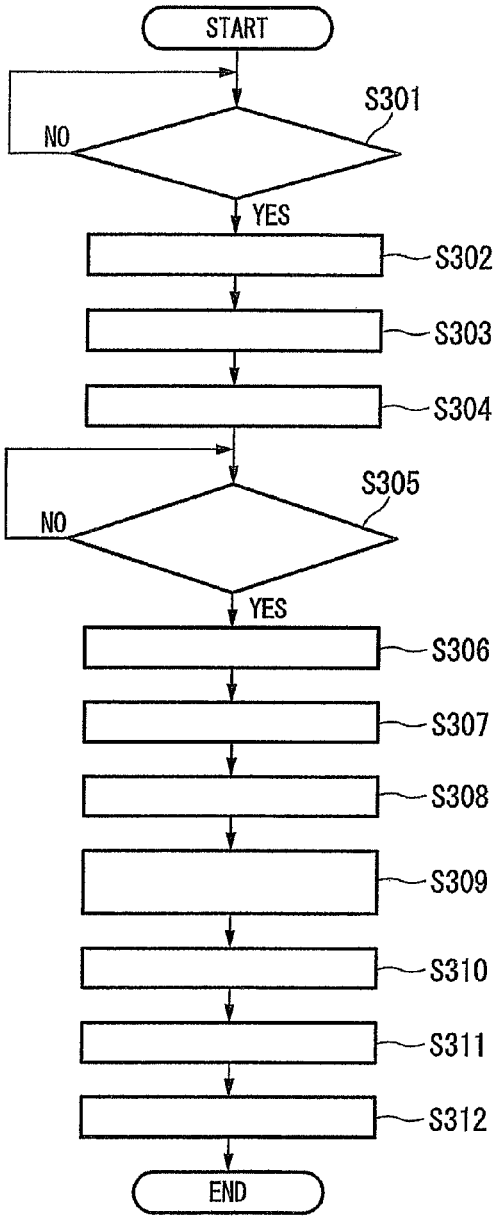

S301 IS TIME CORRECTION INSTRUCTION INPUT?
S302 ACQUIRE CURRENT TIME
S303 DETERMINE DESIGNATION TIME
S304 DISPLAY DESIGNATION TIME
S305 IS INSTRUCTION TO TRANSMIT TIME CORRECTION AMOUNT INPUT?
S306 ACQUIRE CURRENT TIME
S307 CALCULATE TIME CORRECTION AMOUNT
S308 CALCULATE ADDITIONAL CORRECTION AMOUNT
S309 ADD ADDITIONAL CORRECTION AMOUNT TO TIME CORRECTION AMOUNT
S310 TRANSMIT SYNCHRONIZING SIGNAL
S311 TRANSMIT START SIGNAL
S312 TRANSMIT TIME CORRECTION AMOUNT DATA

FIG.5

TIME CORRECTION SYSTEM, ELECTRONIC DEVICE, TIMEPIECE, AND PROGRAM

TECHNICAL FIELD

The present invention relates to a time correction system, an electronic device, a timepiece, and a program.

This application is based upon and claims the benefit of priority from Japanese Patent Application No. 2013-234256, filed on Nov. 12, 2013, the entire content of which is incorporated herein by reference.

BACKGROUND ART

In the related art, a time correction system is known which corrects the time of a timepiece by using a correction instruction device such as a computer. For example, according to a technique disclosed in PTL 1, the correction instruction device receives an input of instruction time data instructed by the timepiece, and transmits reference time data and instruction time data to the timepiece. The timepiece corrects indication of an indicating hand, based on the reference time data and the instruction time data which are received from the correction instruction device.

CITATION LIST

Patent Literature

[PTL 1] Japanese Patent No. 4200835

SUMMARY OF INVENTION

Technical Problem

However, according to the technique disclosed in PTL 1, based on the reference time data and the instruction time data which are received by the timepiece, a difference therebetween is calculated. Consequently, there is a problem in that a load applied to the timepiece increases due to complicated arithmetic processing in the timepiece.

Therefore, the present invention is made in view of the above-described circumstances, and an object thereof is to provide a time correction system, an electronic device, a timepiece, and a program which can easily correct the time of the timepiece to the right time by reducing a load applied to the timepiece.

Solution to Problem

According to some aspects of the present invention, there is provided a time correction system including a timepiece that has a display unit which causes an indicating hand to display the time, and an electronic device. The electronic device includes a display unit, an acquisition unit that acquires the current time, a determination unit that determines an instruction time for adjusting the time of the timepiece, based on the current time acquired by the acquisition unit, a display control unit that causes the display unit to display the instruction time determined by the determination unit, a time correction amount calculation unit that calculates a time correction amount for correcting the time of the timepiece from a difference between the current time acquired by the acquisition unit and the instruction time determined by the determination unit, and a transmitting unit that transmits the time correction amount calculated by the time correction amount calculation unit to the timepiece. The timepiece includes an input unit that receives an operation input for correcting the time displayed by a display unit, a receiving unit that receives the time correction amount from the electronic device, and a control unit that corrects the time displayed by the indicating hand, based on the time correction amount received by the receiving unit.

In addition, in the time correction system according to another aspect of the present invention, the control unit of the timepiece may stop driving the indicating hand, if the input unit receives the operation input for correcting the time, and may restart the driving the indicating hand, if the receiving unit receives the time correction amount.

In addition, in the time correction system according to another aspect of the present invention, the electronic device may include an additional correction amount calculation unit which calculates an additional correction amount corresponding to a period of time required for correction in the timepiece, based on the time correction amount calculated by the time correction amount calculation unit, and which adds the calculated additional correction amount to the time correction amount.

In addition, in the time correction system according to another aspect of the present invention, the transmitting unit of the electronic device may transmit the current time together with the time correction amount. The receiving unit of the timepiece may receive the current time together with the time correction amount. The timepiece may include a clocking unit that clocks the current time. The control unit of the timepiece may correct the current time clocked by the clocking unit, based on the current time received by the receiving unit.

In addition, in the time correction system according to another aspect of the present invention, the instruction time may be the time closest to the current time.

In addition, in the time correction system according to another aspect of the present invention, the transmitting unit of the electronic device may be a light source which transmits an optical signal. The receiving unit of the timepiece may be a solar cell which receives the optical signal.

In addition, according to another aspect of the present invention, there is provided an electronic device in a time correction system which includes a timepiece having a display unit for causing an indicating hand to display the time and the electronic device. The electronic device includes a display unit, an acquisition unit that acquires the current time, a determination unit that determines an instruction time for adjusting the time of the timepiece, based on the current time acquired by the acquisition unit, a display control unit that causes the display unit to display the instruction time determined by the determination unit, a time correction amount calculation unit that calculates a time correction amount for correcting the time of the timepiece from a difference between the current time acquired by the acquisition unit and the instruction time determined by the determination unit, and a transmitting unit that transmits the time correction amount calculated by the time correction amount calculation unit to the timepiece.

In addition, according to another aspect of the present invention, there is provided a timepiece in a time correction system which includes the timepiece having a display unit for causing an indicating hand to display the time and an electronic device. The timepiece includes an input unit that receives an operation input for correcting the time displayed by a display unit, a receiving unit that receives the time correction amount for correcting the time from the electronic device, and a control unit that corrects the time displayed by the indicating hand, based on the time correction amount received by the receiving unit.

In addition, according to another aspect of the present invention, there is provided a program that causes a computer to execute a process as an electronic device in a time correction system which includes a timepiece having a display unit for causing an indicating hand to display the time and the electronic device. The process includes a step of acquiring the current time, a step of determining an instruction time for adjusting the time of the timepiece, based on the acquired current time, a step of causing a display unit to display the determined instruction time, a step of calculating a time correction amount for correcting the time of the timepiece from a difference between the acquired current time and the determined instruction time, and a step of transmitting the calculated time correction amount to the timepiece.

Advantageous Effects of Invention

According to some aspects of the present invention, an electronic device determines an instruction time from the current time, and displays the determined instruction time. A user adjusts an indicating hand of a timepiece to the displayed instruction time. Then, the electronic device calculates a time correction amount from a difference between the determined instruction time and the current time, and transmits the calculated time correction amount to the timepiece. The timepiece corrects the time displayed by the indicating hand, based on the received time correction amount. In this manner, the timepiece no longer needs to calculate a difference between the right current time and the time displayed by the timepiece. Therefore, it is possible to easily correct the time of the timepiece to the right time by reducing a load applied to the timepiece.

BRIEF DESCRIPTION OF DRAWINGS

FIG. 5 is a flowchart illustrating a processing procedure in a time correction process performed by an electronic device according to a second embodiment.

DESCRIPTION OF EMBODIMENTS

Figure 1:
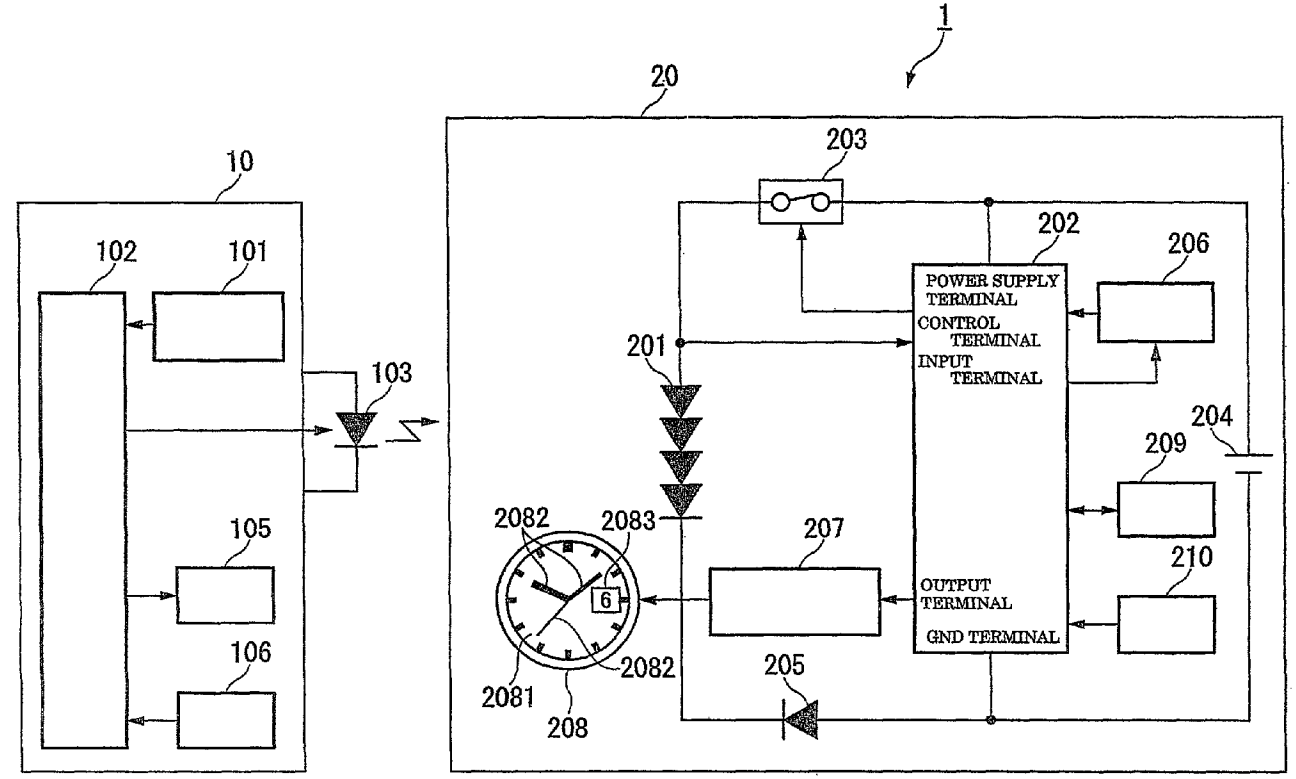
FIG. 1 is a schematic view illustrating a configuration of a time correction system according to a first embodiment of the present invention.

Hereinafter, embodiments of the present invention will be described with reference to the drawings. The same reference numerals will be given to the same elements in each drawing.

First Embodiment

First, a first embodiment of the present invention will be described. FIG. 1 is a schematic view illustrating a configuration of a time correction system 1 according to the present embodiment. In the illustrated example, the time correction system 1 includes an electronic device 10 and an electronic timepiece 20. For example, the electronic device 10 is an electronic device such as a smartphone, a mobile phone, and a tablet terminal. In the illustrated example, the electronic device 10 includes a time data acquisition unit 101, a control unit 102, a light source 103, a display unit 105, and an input unit 106.

The time data acquisition unit 101 acquires the current time (second, minute, and hour). For example, the time data acquisition unit 101 employs a method of acquiring the current time by getting access to a time server on the Internet, a method of acquiring the current time by using a Global Positioning System (GPS), or a method of acquiring the current time by using a control signal transmitted from a base station. Any method may be employed in order to acquire the current time.

The control unit 102 controls each unit included in the electronic device 10. In addition, the control unit 102 (determination unit) determines an instruction time, based on the current time acquired by the time data acquisition unit 101. Specifically, the control unit 102 determines the right time closest to the current time as the instruction time. That is, the instruction time means the time for a user to easily adjust the time to the right time. Then, the control unit 102 (display control unit) causes the display unit 105 to display the determined instruction time. In addition, the control unit 102 (time correction amount calculation unit) calculates a time correction amount for correcting the time of the electronic timepiece 20 from a difference between the determined instruction time and the current time acquired by the time data acquisition unit 101. Subsequently, the control unit 102 outputs time correction amount data indicating the calculated time correction amount by using the light source 103, as an optical signal. In this case, the control unit 102 outputs a synchronizing signal, and thereafter outputs a start signal. Thereafter, the control unit 102 outputs the time correction amount data.

For example, the light source 103 is a Light Emitting Diode (LED) for a flash belonging to the electronic device 10 or a backlight of a liquid crystal display. The light source 103 is operated as a transmitting unit which transmits an optical signal representing the time correction amount data to the electronic timepiece 20. The display unit 105 is a liquid crystal display (LCD), and displays information. The input unit 106 includes a switch, and receives an input.

The electronic timepiece 20 displays the time in an analog display manner. In the illustrated example, the electronic timepiece 20 includes a solar cell 201, a control circuit 202, a switch 203, a secondary battery 204, a diode 205, a reference signal generation circuit 206, a stepping motor 207, a display unit 208, a storage unit 209, and an input unit 210. The display unit 208 includes a dial 2081, an indicating hand 2082, and a date display section 2083.

In a charging period, the solar cell 201 is operated as a power generation unit which receives light (sunlight or illumination rays) and converts the light into electric energy. In addition, in a communication period, the solar cell 201 performs optical communication with the electronic device 10, and is operated as a receiving unit which receives an optical signal representing the time correction amount data from the electronic device 10. The charging period and the communication period will be described later.

The control circuit 202 controls each unit included in the electronic timepiece 20. In addition, the control circuit 202 controls the solar cell 201 to charge the secondary battery 204. In addition, the control circuit 202 performs an overcharging prevention control for the secondary battery 204. In addition, the control circuit 202 performs optical communication by using the solar cell 201. For example, the control circuit 202 is operated by using power output from the secondary battery 204 which is connected to a power supply terminal and a GND terminal. In this case, the control circuit 202 detects an output voltage of the secondary battery 204, thereby determining a charging state (fully charged or over-discharged state) of the secondary battery 204 and performing a predetermined charging control. For example, the control circuit 202 controls the switch 203 to be turned on and off in response to a charging state of the secondary battery 204 by using a control signal output from a control terminal. In this manner, the control circuit 202 connects the solar cell 201 and the secondary battery 204 to each other, thereby charging the secondary battery 204. In addition, the control circuit 202 disconnects the solar cell 201 and the secondary battery 204 from each other, thereby preventing the secondary battery 204 from being overcharged.

In addition, the control circuit 202 outputs a switch control signal, based on a reference signal output from the reference signal generation circuit 206, thereby controlling the switch 203 to be turned on and off. In this manner, the control circuit 202 connects the solar cell 201 and the secondary battery 204 to each other, and disconnects the solar cell 201 and the secondary battery 204 from each other.

In addition, the control circuit 202 (control unit) stops clocking (driving the indicating hand 2082), if the input unit 210 receives an operation input for correcting the time. Thereafter, the control circuit 202 brings the switch 203 into an OFF-state, and changes the mode to a communication period.

In addition, the control circuit 202 (control unit) detects an output voltage of the solar cell 201 input to an input terminal in the communication period, and converts the detected voltage into an electrical signal, thereby receiving the time correction amount data transmitted from an external device (in the present embodiment, the electronic device 10) through optical communication. Then, the control circuit 202 drives the stepping motor 207, based on the received time correction amount data. The control circuit 202 corrects the time displayed by the indicating hand 2082, and restarts clocking (driving the indicating hand 2082).

Based on a switch control signal input from the control circuit 202, the switch 203 connects the solar cell 201 and the secondary battery 204 to each other, and disconnects the solar cell 201 and the secondary battery 204 from each other. The secondary battery 204 supplies power to each unit included in the electronic timepiece 20. The diode 205 prevents a current from reversely flowing into the secondary battery 204. The reference signal generation circuit 206 has an oscillator circuit (for example, 32 kHz) and a frequency divider circuit, and generates a reference signal of 1 Hz, for example.

The stepping motor 207 drives (rotates) the indicating hand 2082 and the date display section 2083, based on a pulse signal input from the control circuit 202. The display unit 208 displays the time and the date in an analog display manner using the dial 2081, the indicating hand 2082, and the date display section 2083. The display unit 208 displays the time by using the dial 2081 and the indicating hand 2082, and displays the date by using the date display section 2083. For example, the storage unit 209 is a non-volatile memory, and stores data used by each unit included in the electronic timepiece 20. The input unit 210 receives an operation input from a user. For example, the input unit 210 includes a crown or a button, and receives the operation input for correcting the time displayed by the display unit 208.

Next, a communication method between the electronic device 10 and the electronic timepiece 20 will be described. According to the present embodiment, the electronic device 10 transmits data by using the light source 103. For example, the electronic device 10 causes the light source 103 to emit light when "1" is transmitted, and causes the light source 103 to stop emitting light when "0" is transmitted. In addition, the electronic timepiece 20 receives data by using the solar cell 201. For example, the control circuit 202 of the electronic timepiece 20 determines that "1" is received when the solar cell 201 receives the light and generates a voltage, and determines that "0" is received when the solar cell 201 does not generate the voltage.

When the solar cell 201 and the secondary battery 204 are connected to each other, the voltage generated by the solar cell 201 cannot be accurately determined due to an output voltage of the secondary battery 204. Therefore, according to the present embodiment, when data is received, the switch 203 is controlled in order to more accurately detect the voltage generated by the solar cell 201, thereby disconnecting the solar cell 201 and the secondary battery 204 from each other. A period while the solar cell 201 and the secondary battery 204 are disconnected from each other is referred to as a "communication period (OFF-period)".

In addition, in a period except for the communication period, the switch 203 is controlled, thereby connecting the solar cell 201 and the secondary battery 204 to each other. A period while the solar cell 201 and the secondary battery 204 are connected to each other is referred to as a "charging period (ON-period)". In this manner, in a receiving period, data can be more accurately received.

In addition, the secondary battery 204 cannot be charged in the communication period. For this reason, it is desirable that the communication period is short. Therefore, according to the present embodiment, the electronic timepiece 20 usually employs the charging period, and employs the short communication period at regular intervals. Then, when receiving a synchronizing signal from the electronic device 10 in the short communication period, the electronic timepiece 20 continuously maintains the communication period until the time correction amount data is received. In contrast, when the synchronizing signal is not received from the electronic device 10 in the communication period, the electronic timepiece 20 maintains the charging period.

Figure 2:
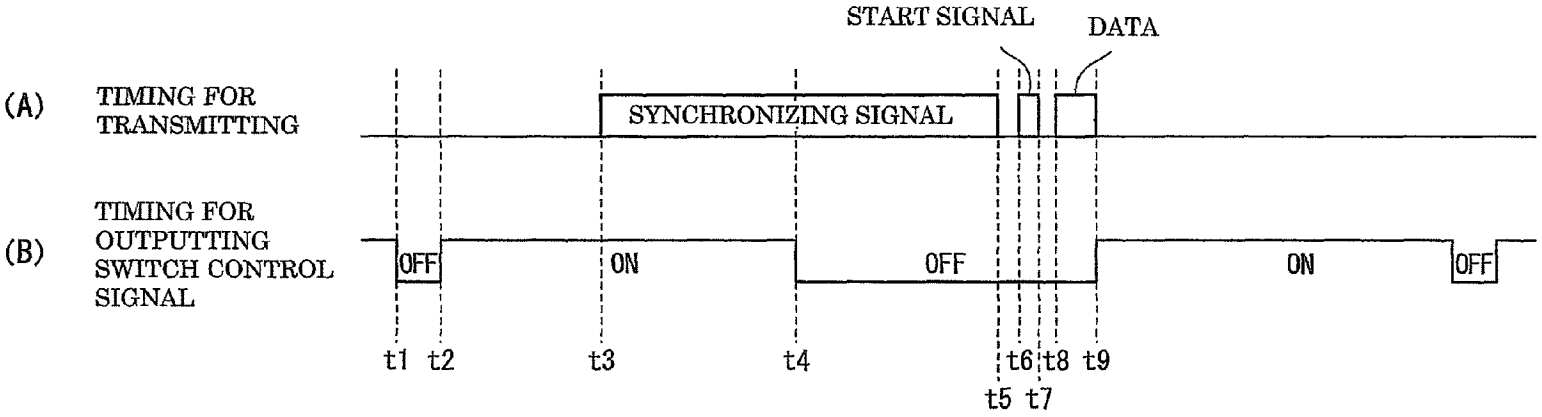
FIG. 2 is a timing chart for describing an operation example of an electronic timepiece according to the first embodiment.

FIG. 2(A) is a timing chart illustrating timing for the electronic device 10 to transmit the synchronizing signal, start signal, and time correction amount data to the electronic timepiece 20. FIG. 2(B) is a timing chart illustrating timing for the control circuit 202 of the electronic timepiece 20 to output the switch control signal.

As illustrated in FIG. 2(A), when transmitting the time correction amount data, the electronic device 10 transmits the synchronizing signal (time t3 to time t5). Thereafter, the electronic device 10 transmits the start signal (time t6 to time t7). Thereafter, the electronic device 10 transmits the time correction amount data (time t8 to time t9).

In addition, as illustrated in FIG. 2(B), after a fixed period of time elapses from when the mode is changed to the charging period, the electronic timepiece 20 turns off the switch 203, and changes the mode to the communication period (time t1). In addition, the electronic timepiece 20 does not receive the synchronizing signal from when the mode is changed to the communication period. After a fixed period of time elapses, the electronic timepiece 20 turns on the switch 203, and changes the mode to the charging period (time t2). In addition, after a fixed period of time elapses from when the mode is changed to the charging period, the electronic timepiece 20 turns off the switch 203, and changes the mode to the communication period (time t4). At time t4, since the synchronizing signal is transmitted from the electronic device 10, the electronic timepiece 20 receives the synchronizing signal. The electronic timepiece 20 receives the synchronizing signal, thereby changing the mode to the communication period until time t9 when the time correction amount data is completely received. In addition, when the time correction amount data is completely received, the electronic timepiece 20 changes the mode to the charging period (time t9). Thereafter, similarly, the electronic timepiece 20 repeatedly changes the charging period and the communication period, and receives the time correction amount data transmitted from the electronic device 10.

As described above, the electronic timepiece 20 repeatedly changes the charging period and the communication period which is shorter than the charging period. In addition, when the synchronizing signal is received in the shorter communication period, the electronic timepiece 20 changes the mode to the communication period until the time correction amount data is completely received. In this manner, the electronic timepiece 20 can more accurately receive an optical signal while further lengthening the charging period.

Figure 3:
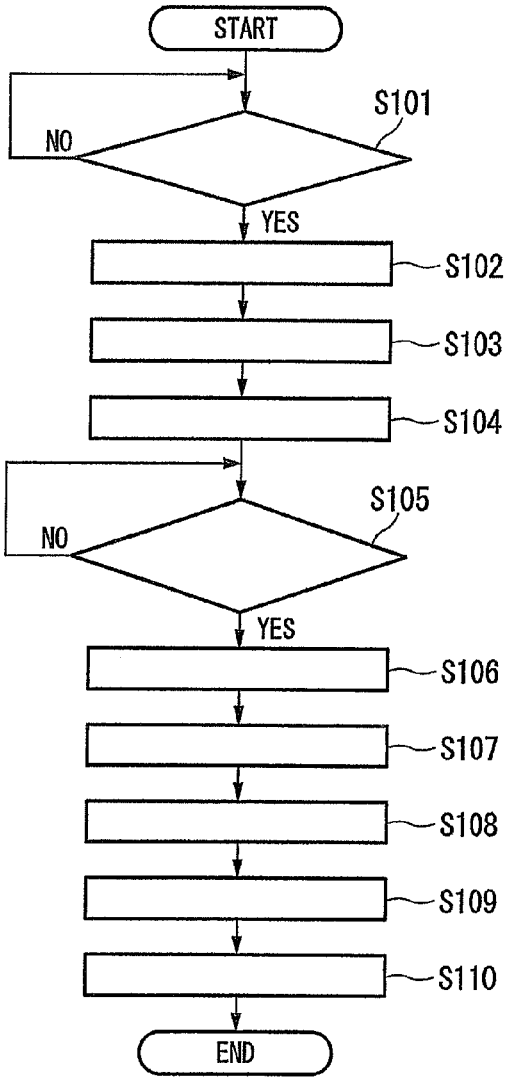
FIG. 3 is a flowchart illustrating a processing procedure in a time correction process performed by an electronic device according to the first embodiment.

Next, referring to FIGS. 3 and 4, a time correction method in the time correction system 1 will be described. FIG. 3 is a flowchart illustrating a processing procedure in a time correction process performed by the electronic device 10 according to the present embodiment.

(Step S101)

A user operates the input unit 106 of the electronic device 10, and inputs a time correction instruction. When the input unit 106 of the electronic device 10 receives the input of the time correction instruction, the process proceeds to Step S102.

(Step S102)

The time data acquisition unit 101 acquires the accurate current time. Thereafter, the process proceeds to Step S103.

(Step S103)

The control unit 102 determines an instruction time, based on the current time acquired by the time data acquisition unit 101 in the process in Step S102. For example, the control unit 102 determines the right time closest to the current time. Specifically, the control unit 102 determines the instruction time as "14:00 (14 o'clock)" when the current time is "13:55 (55 minutes, 13 o'clock)". Thereafter, the process proceeds to Step S104.

(Step S104)

The control unit 102 causes the display unit 105 to display the instruction time determined in the process in Step S103. In this case, the control unit 102 causes the display unit 105 to display an instruction of "Adjust the timepiece to the instruction time" together with the instruction time. A user adjusts the indicating hand 2082 of the electronic timepiece 20 to the displayed instruction time. Thereafter, the process proceeds to Step S105.

(Step S105)

The control unit 102 receives an input of an instruction to transmit the time correction amount from the input unit 106. For example, the control unit 102 causes the display unit 105 to display an instruction of "Press the finish button upon adjusting the time" and the finish button. When the finish button is pressed via the input unit 106, the control unit 102 determines that the instruction to transmit the time correction amount is input. If the user adjusts the indicating hand 2082 of the electronic timepiece 20 to the instruction time, the user operates the input unit 106, and presses the finish button. When the control unit 102 receives an input indicating that the finish button is pressed down from the input unit 106, the process proceeds to Step S106.

(Step S106)

The time data acquisition unit 101 acquires the accurate current time. Thereafter, the process proceeds to Step S107.

(Step S107)

The control unit 102 calculates a difference between the instruction time determined in the process in Step S103 and the current time acquired by the time data acquisition unit 101 in the process in Step S106, thereby calculating a time lag of the electronic timepiece 20. In addition, in order to reconcile the time lag of the electronic timepiece 20, the control unit 102 calculates an amount for driving the indicating hand 2082 of the electronic timepiece 20. That is, the control unit 102 calculates an amount for driving the stepping motor 207. Hereinafter, the amount for driving the stepping motor 207 of the electronic timepiece 20 in order to reconcile the time lag of the electronic timepiece 20 is referred to as the time correction amount. For example, the stepping motor 207 is operated one step, thereby causing the indicating hand 2082 to move forward one second. In this case, when the time displayed by the display unit 208 of the electronic timepiece 20 is delayed 10 seconds, the time correction amount is "10". In addition, data indicating the time correction amount is referred to as the time correction amount data. Thereafter, the process proceeds to Step S108.

(Step S108)

The control unit 102 controls the light source 103 so as to transmit the synchronizing signal. Thereafter, the process proceeds to Step S109.

(Step S109)

The control unit 102 controls the light source 103 so as to transmit the start signal. Thereafter, the process proceeds to Step S110.

(Step S110)

The control unit 102 controls the light source 103 so as to transmit the time correction amount data. Thereafter, the process ends.

Figure 4:
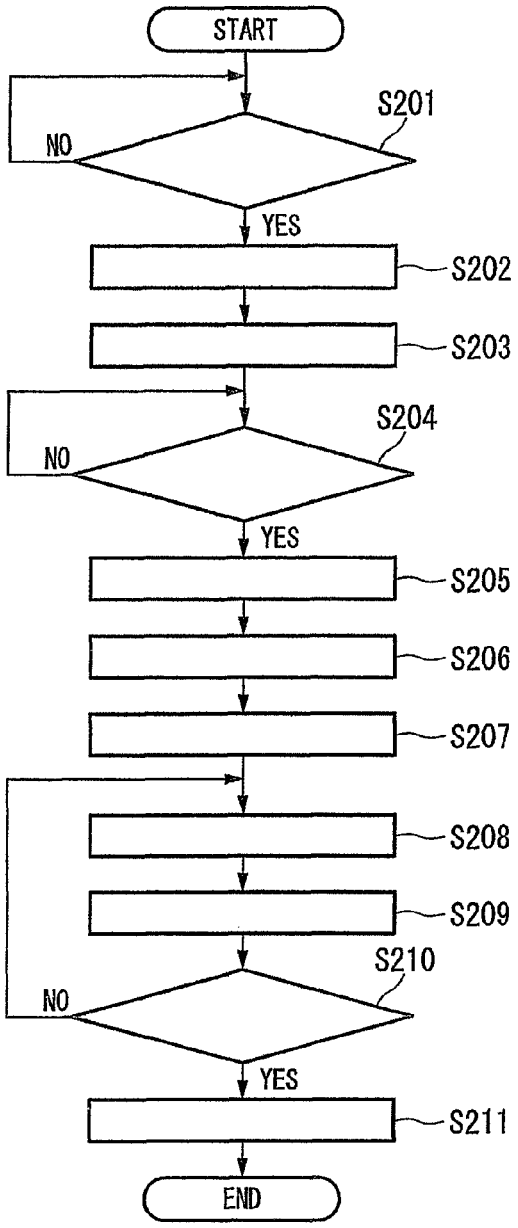
FIG. 4 is a flowchart illustrating a processing procedure in the time correction process performed by the electronic timepiece according to the first embodiment.

FIG. 4 is a flowchart illustrating a processing procedure in a time correction process performed by the electronic timepiece 20 according to the present embodiment.

(Step S201)

The control circuit 202 controls the switch 203 so as to control a mode change between the communication period and the charging period at regular intervals. If the electronic device 10 displays the instruction time in the process in Step S104 described above, a user operates the input unit 210 of the electronic timepiece 20 so as to adjust the indicating hand 2082 of the electronic timepiece 20 to the instruction time. For example, the user pulls out and rotates a crown included in the input unit 210, thereby moving the indicating hand 2082. The control circuit 202 of the electronic timepiece 20 determines that the time is completely corrected when the crown pulled out once is pressed again. When the time is completely corrected, the control circuit 202 causes the process to proceed to Step S202.

(Step S202)

The control circuit 202 stops clocking. Thereafter, the process proceeds to Step S203.

(Step S203)

The control circuit 202 brings the switch 203 into an OFF-state, and changes the mode to the communication period. Thereafter, the process proceeds to Step S204.

(Step S204)

The control circuit 202 determines whether or not the synchronizing signal is received via the solar cell 201. When the control circuit 202 determines that the synchronizing signal is received, the process proceeds to Step S205. Otherwise, the process returns to Step S204.

(Step S205)

The control circuit 202 receives the start signal and the time correction amount data via the solar cell 201. Thereafter, the process proceeds to Step S206.

(Step S206)

The control circuit 202 brings the switch 203 into an ON-state, and changes the mode to the charging period. Thereafter, the process proceeds to Step S207.

(Step S207)

The control circuit 202 sets the time correction amount, based on the time correction amount data received in the process in Step S205. Thereafter, the process proceeds to Step S208.

(Step S208)

The control circuit 202 drives the stepping motor 207 one step. Thereafter, the process proceeds to Step S209.

(Step S209)

The control circuit 202 deducts 1 from the set time correction amount, and sets the deducted value as the time correction amount. Thereafter, the process proceeds to Step S210.

(Step S210)

The control circuit 202 determines whether or not the set time correction amount is zero. When the set time correction amount is zero, the control circuit 202 causes the process to proceed to Step S211. Otherwise, the process returns to Step S208.

(Step S211)

The control circuit 202 restarts the clocking. Thereafter, the process ends.

As described above, according to the present embodiment, the electronic device 10 determines the instruction time for adjusting the time of the electronic timepiece 20, based on the current time, and displays the determined instruction time. For example, the instruction time is the right time closest to the current time. That is, the instruction time means the time for a user to easily adjust the time to the right time. This enables the user to easily adjust the indicating hand 2082 of the timepiece to the instruction time. Then, if the user completely adjusts the time, the electronic device 10 calculates the time correction amount, based on a difference between the current time and the instruction time, and transmits the calculated time correction amount to the electronic timepiece 20. Based on the received time correction amount, the electronic timepiece 20 corrects the time displayed by the display unit 208. In this manner, it is possible to more accurately and easily correct the time displayed by the electronic timepiece 20 to the right time. In addition, since the electronic device 10 calculates the time correction amount, it is possible to reduce a processing load of the electronic timepiece 20. In addition, the time of the electronic timepiece 20 is adjusted in advance to the instruction time close to the current time. Accordingly, when the electronic timepiece 20 corrects the time, based on the time correction amount, a driving amount of the stepping motor 207 can be minimized.

In addition, the electronic device 10 and the electronic timepiece 20 transmit and receive the time correction amount by using the above-described optical communication method. Accordingly, a connector for wired communication between the electronic device 10 and the electronic timepiece 20 or an antenna for wireless communication therebetween is not necessarily mounted on the electronic device 10 or the electronic timepiece 20. That is, the electronic device 10 can communicate with the light source 103, and the electronic timepiece 20 can communicate with a standard device such as the solar cell 201. Therefore, there is no possibility that design features of the electronic device 10 or the electronic timepiece 20 may become poor due to a newly mounted device.

Second Embodiment

Next, a second embodiment of the present invention will be described. A configuration of the time correction system 1 according to the present embodiment is the same as that according to the first embodiment illustrated in FIG. 1. In addition, an optical communication method of the time correction system 1 according to the present embodiment is the same as the optical communication method illustrated in FIG. 2. The present embodiment and the first embodiment are different from each other in that the electronic device 10 transmits the time correction amount data to the electronic timepiece 20 by adding an additional correction amount to the time correction amount. The additional correction amount means an amount for driving the stepping motor 207 of the electronic timepiece 20 which corresponds to a period of time needed to correct the time in the electronic timepiece 20. As the time correction amount increases, the additional correction amount increases. As the time correction amount decreases, the additional correction amount decreases. The reason is considered that a period of time is needed to correct the time as the time correction amount increases.

Specifically, the control unit 102 (additional correction amount calculation unit) of the electronic device 10 calculates the time correction amount, and calculates the additional correction amount, based on the calculated time correction amount. Then, the control unit 102 uses the light source 103 so as to output the time correction amount data obtained by adding the additional correction amount to the time correction amount, as an optical signal. Other configurations of the electronic device 10 are the same as those according to the first embodiment, and thus description thereof will be omitted. In addition, a configuration of the electronic timepiece 20 is the same as that according to the first embodiment, and thus description thereof will be omitted.

Next, referring to FIG. 5, a time correction method in the time correction system 1 according to the present embodiment will be described. FIG. 5 is a flowchart illustrating a processing procedure in a time correction process performed by the electronic device 10 according to the present embodiment.

(Step S301)

A user operates the input unit 106 of the electronic device 10 so as to input an instruction to correct the time. When the input unit 106 of the electronic device 10 receives the input of the instruction to correct the time, the process proceeds to Step S302.

(Step S302)

The time data acquisition unit 101 acquires the accurate current time. Thereafter, the process proceeds to Step S303.

(Step S303)

The control circuit 102 determines the instruction time, based on the current time acquired by the time data acquisition unit 101 in the process in Step S302. For example, the control unit 102 determines the right time closest to the current time as the instruction time. Thereafter, the process proceeds to Step S304.

(Step S304)

The control unit 102 causes the display unit 105 to display the instruction time determined in the process in Step S303.

In this case, the control unit 102 causes the display unit 105 to display an instruction of "Adjust the timepiece to the instruction time" together with the instruction time. A user adjusts the indicating hand 2082 of the electronic timepiece 20 to the displayed instruction time. Thereafter, the process proceeds to Step S305.

(Step S305)

The control unit 102 receives an input of an instruction to transmit the time correction amount from the input unit 106. For example, the control unit 102 causes the display unit 105 to display an instruction of "Press the finish button upon adjusting the time" and the finish button. When the finish button is pressed via the input unit 106, the control unit 102 determines that the instruction to transmit the time correction amount is input. If the user adjusts the indicating hand 2082 of the electronic timepiece 20 to the instruction time, the user operates the input unit 106, and presses the finish button. When the control unit 102 receives an input indicating that the finish button is pressed down, the process proceeds to Step S306.

(Step S306)

The time data acquisition unit 101 acquires the accurate current time. Thereafter, the process proceeds to Step S307.

(Step S307)

The control unit 102 calculates the time correction amount, based on a difference between the instruction time determined in the process in Step S303 and the current time acquired by the time data acquisition unit 101 in the process in Step S306. Thereafter, the process proceeds to Step S308.

(Step S308)

The control unit 102 calculates the additional correction amount, based on the time correction amount calculated in the process in Step S307. Thereafter, the process proceeds to Step S309.

(Step S309)

The control unit 102 adds the additional correction amount calculated in the process in Step S308 to the time correction amount calculated in the process in Step S307. Thereafter, the process proceeds to Step S310.

(Step S310)

The control unit 102 controls the light source 103 so as to transmit the synchronizing signal. Thereafter, the process proceeds to Step S311.

(Step S311)

The control unit 102 controls the light source 103 so as to transmit the start signal. Thereafter, the process proceeds to Step S312.

(Step S312)

The control unit 102 controls the light source 103 so as to transmit the time correction amount data. Thereafter, the process ends.

The processing procedure in the time correction process performed by the electronic timepiece 20 according to the present embodiment is the same as the processing procedure in the time correction process performed by the electronic timepiece 20 according to the first embodiment illustrated in FIG. 4, and thus description thereof will be omitted.

As described above, according to the present embodiment, the electronic device 10 calculates the additional correction amount, based on the calculated time correction amount, and transmits the time correction amount data obtained by adding the additional correction amount to the time correction amount, to the electronic timepiece 20. That is, the electronic device 10 and the electronic timepiece 20 correct the time in view of a period of time needed to correct the time. Therefore, in addition to an advantageous effect according to the first embodiment, the time can be more accurately corrected.

Functions of the respective units included in the electronic device 10 or the electronic timepiece 20 according to the above-described embodiments may be entirely or partially realized in such a way that a program for realizing these functions is recorded on a computer-readable recording medium and the program recorded on the recording medium is read and executed by a computer system. The "computer system" described herein includes an OS or hardware such as peripheral devices.

In addition, the "computer-readable recording medium" means a portable medium such as a flexible disk, a magneto-optical disk, a ROM, and a CD-ROM, and a storage unit such as a hard disk incorporated in a computer system. Furthermore, the "computer-readable recording medium" may include those which dynamically hold a program during a short period of time such as network of Internet and communication cables used in a case where the program is transmitted via a communication line of a telephone line, or those which hold the program during a certain period of time such as a volatile memory installed in the computer system functioning as a server or a client in that case. In addition, the above-described program may be one for partially realizing the above-described functions. Furthermore, the program may be combined with a program which previously recorded in the computer system so that the above-described functions can be realized.

Hitherto, the present embodiments according to the present invention have been described. However, without being limited to the above-described embodiments, the present invention can be modified in various ways within the scope not departing from the gist of the present invention.

For example, according to the above-described embodiments, the electronic timepiece 20 repeatedly changes the mode between the charging period and the communication period for performing the optical communication in a predetermined cycle. However, without being limited thereto, the charging period and the communication period may be switched therebetween by controlling the switch 203 in response to a charging state of the secondary battery 204. Alternatively, the electronic timepiece 20 may first detect the synchronizing signal at a low-speed communication rate, and may receive the start signal and a data signal by switching the low-speed communication rate to a high-speed communication rate (for example, four times the low-speed communication rate) after the synchronizing signal is detected. This can reduce power consumption of the electronic device 10 and the electronic timepiece 20.

In addition, according to the above-described embodiments, the electronic timepiece 20 corrects only the time displayed by the display unit 208, but may correct the date displayed by the display unit 208 in addition to the time. In this case, the time data acquisition unit 101 of the electronic device 10 acquires the current date and time (current time (hour, minute, and second) and current date (year, month, and day)). In addition, the control unit 102 determines the instruction date, based on the current date acquired by the time data acquisition unit 101. A user adjusts the date display section 2083 of the electronic timepiece 20 to the instruction date displayed on the display unit 105 of the electronic device 10. The control unit 102 calculates a date correction amount for correcting the date from a difference between the instruction date and the current date acquired by the time data acquisition unit 101. Then, the control unit 102 transmits data indicating the time correction amount and the date correction amount to the electronic timepiece 20. The control circuit 202 of the electronic timepiece 20 corrects the time and the date which are displayed by the display unit 208, based on the received time correction amount and the received date correction amount.

REFERENCE SIGNS LIST

1 TIME CORRECTION SYSTEM
10 ELECTRONIC DEVICE
20 ELECTRONIC TIMEPIECE
101 TIME DATA ACQUISITION UNIT
102 CONTROL UNIT
103 LIGHT SOURCE
105 DISPLAY UNIT
106 INPUT UNIT
201 SOLAR CELL
202 CONTROL CIRCUIT
203 SWITCH
204 SECONDARY BATTERY
205 DIODE
206 REFERENCE SIGNAL GENERATION CIRCUIT
207 STEPPING MOTOR
208 DISPLAY UNIT
209 STORAGE UNIT
210 INPUT UNIT
2081 DIAL
2082 INDICATING HAND
2083 DATE DISPLAY SECTION

The invention claimed is:

1. A time correction system comprising:
a timepiece that has a display unit which causes an indicating hand to display the time; and
an electronic device that includes:
a display unit,
an acquisition unit that acquires the current time,
a determination unit that determines an instruction time for adjusting the time of the timepiece, based on the current time acquired by the acquisition unit,
a display control unit that causes the display unit to display the instruction time determined by the determination unit,
a time correction amount calculation unit that calculates a time correction amount for correcting the time of the timepiece from a difference between the current time acquired by the acquisition unit and the instruction time determined by the determination unit, and
a transmitting unit that transmits the time correction amount calculated by the time correction amount calculation unit to the timepiece, and
wherein the timepiece includes
an input unit that receives an operation input for correcting the time displayed by the display unit,
a receiving unit that receives the time correction amount from the electronic device, and
a control unit that corrects the time displayed by the indicating hand, based on the time correction amount received by the receiving unit.

2. The time correction system according to claim 1, wherein the control unit of the timepiece stops driving the indicating hand, if the input unit receives the operation input for correcting the time, and restarts the driving the indicating hand, if the receiving unit receives the time correction amount.

3. The time correction system according to claim 1, wherein the electronic device includes an additional correction amount calculation unit which calculates an additional correction amount corresponding to a period of time required for correction in the timepiece, based on the time correction amount calculated by the time correction amount calculation unit, and which adds the calculated additional correction amount to the time correction amount.

4. The time correction system according to claim 1,
wherein the transmitting unit of the electronic device transmits the current time together with the time correction amount,
wherein the receiving unit of the timepiece receives the current time together with the time correction amount,
wherein the timepiece includes a clocking unit that clocks the current time, and
wherein the control unit of the timepiece corrects the current time clocked by the clocking unit, based on the current time received by the receiving unit.

5. The time correction system according to claim 1, wherein the instruction time is the time closest to the current time.

6. The time correction system according to claim 1,
wherein the transmitting unit of the electronic device is a light source which transmits an optical signal, and
wherein the receiving unit of the timepiece is a solar cell which receives the optical signal.

7. An electronic device in a time correction system which includes a timepiece having a display unit for causing an indicating hand to display the time and the electronic device, comprising:
a display unit;
an acquisition unit that acquires the current time;
a determination unit that determines an instruction time for adjusting the time of the timepiece, based on the current time acquired by the acquisition unit;
a display control unit that causes the display unit to display the instruction time determined by the determination unit;
a time correction amount calculation unit that calculates a time correction amount for correcting the time of the timepiece from a difference between the current time acquired by the acquisition unit and the instruction time determined by the determination unit; and
a transmitting unit that transmits the time correction amount calculated by the time correction amount calculation unit to the timepiece.

8. A program that causes a computer to execute a process as an electronic device in a time correction system which includes a timepiece having a display unit for causing an indicating hand to display the time and the electronic device, the process comprising:
a step of acquiring the current time;
a step of determining an instruction time for adjusting the time of the timepiece, based on the acquired current time;
a step of causing a display unit to display the determined instruction time;
a step of calculating a time correction amount for correcting the time of the timepiece from a difference between the acquired current time and the determined instruction time; and
a step of transmitting the calculated time correction amount to the timepiece.

* * * * *